United States Patent [19]

Janish

[11] 4,106,645

[45] Aug. 15, 1978

[54] MEANS FOR QUICK ATTACHMENT OF IMPLEMENT TO A TRACTOR

[76] Inventor: Rudolph G. Janish, Parkston, S. Dak. 57366

[21] Appl. No.: 816,722

[22] Filed: Jul. 18, 1977

[51] Int. Cl.[2] ..... E02F 3/81

[52] U.S. Cl. ..... 214/145 A; 172/275; 280/477

[58] Field of Search ..... 214/131 A, 145 A; 280/477, 478 B, 508, 510, 515; 172/272, 273, 275; 188/31, 69

[56] References Cited

U.S. PATENT DOCUMENTS

| | | | |
|---|---|---|---|
| 2,935,802 | 5/1960 | Wolfe et al. | 172/273 X |
| 3,266,817 | 8/1966 | Engstrom | 172/275 X |
| 3,389,819 | 6/1968 | Schumacher | 214/145 A X |
| 3,512,665 | 5/1970 | Westendorf | 214/145 A |
| 3,985,249 | 10/1976 | Aker et al. | 214/145 A |

FOREIGN PATENT DOCUMENTS

| | | | |
|---|---|---|---|
| 2,302,012 | 9/1976 | France | 172/275 |
| 1,079,472 | 4/1960 | Fed. Rep. of Germany | 280/515 |

*Primary Examiner*—L. J. Paperner

[57] ABSTRACT

A device for the easy and quick connection of a front mounted implement to a tractor including a hook means adapted to lift the device and spring-loaded pin means to fix the position of the device relative to the hook.

3 Claims, 2 Drawing Figures

MEANS FOR QUICK ATTACHMENT OF IMPLEMENT TO A TRACTOR

BACKGROUND AND SUMMARY OF THE INVENTION

This invention pertains to devices mounted on the front end of farm tractors and the like, and more particularly to a method of attaching such items as loaders, bale carriers, snow scoops, hayforks and similar equipment to a tractor quickly and easily and providing equally quick and each detachment.

In current practice there are many types of tools which are adapted to be mounted on the front end of a tractor. In farm practice these include such things as manure loaders, snow scoops, hayforks and bale carriers. Also, in industrial uses, such things as fork lift units and loading buckets may be used.

Particularly in farm practice, it is highly desirable that the operator be able to make a quick change from one such type of tool to another. This kind of change is not possible with most present equipment.

Most equipment at present requires careful alignment of holes in the mounting bar on the tractor with holes on the particular implement to be mounted so that a pin or bolt can be run through the holes and the implement fastened to the bar. Thus, the tractor must be maneuvered carefully into a certain place, and the lifting arms raised or lowered precisely to align the holes.

There have been previous efforts to alleviate or solve the problem. These have generally included a hook on the mounting bracket combined with some way of fastening the device into place on the hook. However, none of these has been completely satisfactory in its means for anchoring the device to the hook. Nearly all require careful lateral alignment so that the anchoring means could be engaged, and almost none provided any reasonably quick and easy disconnecting means. By my invention, I provide both.

FIGURES

Figure 1:
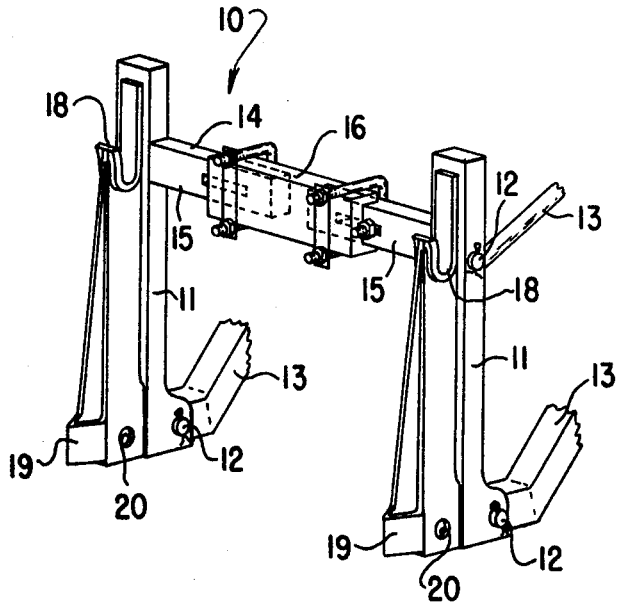
Figure 2:
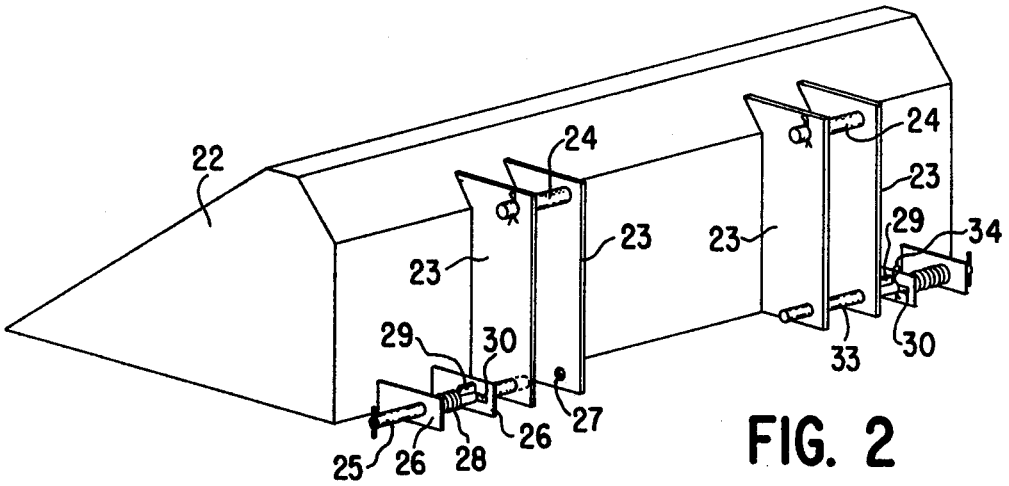

FIG. 1 is a pictorial view of the portion of my device which is to be mounted on the tractor, FIG. 2 is a view similar to FIG. 1 of the matching device on a snow scoop.

DESCRIPTION

Briefly, my invention comprises a device for attachment to the lifting arms of a hydraulic loader on a tractor with a matching device on a scoop, fork or similar implement so that the implement may be quickly and conveniently attached to the lifting arms mounted on the tractor.

More specifically I provide a framework 10 including vertical members 11 adapted to be attached by pins 12 to the ordinary lifting arms 13 of a farm tractor or the like. A horizontal member 14 completes the framework. Although the pins 12 are shown as fixed by cotter keys, it will be apparent that many other fastening methods may be used.

The horizontal member 14 may be a solid bar, but is preferably a telescoping member comprising steel bars 15 extending laterally from each vertical member 11. A channel section 16 adapted to be clamped to the stubs may be used to preserve alignment and proper spacing between the vertical members, while allowing some adjustment of that space between the vertical members. I also envision that a square tube could be substituted for the channel 16 and that other clamping devices could then be used.

On the front of each vertical members is mounted a hook 18 and a V-shaped guide 19. A hole 20 adapted to receive a pin on the implement is formed in the vertical member at about the same horizontal level as the guide 19.

The matching parts on the implement are shown in FIG. 2. The particular implement illustrated is a scoop 22. However, it will be apparent that any sort of device such as a loader, a bale carrier, fork lift, hayfork, etc. might be used also. The parts include pairs of matching walls 23 mounted parallel to each other on the implement, thus forming a channel between them. The hooks 18 are adapted to fit between the walls and catch a pin 24 near the top of the channel. At the lower end of the channel I provide movable pins, two types of which are illustrated.

The movable pin 25 is slidably journalled in ears 26 in position to move into holes 27 in the walls 23. A compression spring 28 biases the pin 25 to the position in which it is extended into the holes 27. The pin may include a fin 29 adapted to slide through a slot 30 in one of the ears. As shown, the pin can be rotated so that the fin is out of register with the slot 30. In that position, the pin is held out of the channel between the walls 23 and the guide 19 from the basic framework can move freely into the channel.

A slightly longer pin 33 may also be used. Again, the structure is similar so that when the pin 33 is withdrawn, and turned, a fin 29 can be used to hold the pin back. However, the pin will then extend partly into the channel. Preferably, the pin extends less than halfway across the channel. In that position, the pin can be engaged by the V-shape of the front of the guide 19. It can then be forced back by the guide and will snap back as soon as it is aligned with the hole 20 in the guide and the pieces will be properly matched. The pin can then be released by turning the fin 29 into register with the slot so that it can be fully extened to hold the two parts together. A cotter key 34 may be used to hold the pin in its fully extended position if it is thought to be necessary.

In use, the tractor carrying the framework 10 is driven up to the implement so that each guide 19 enters the channel between walls 23. The hooks 18 are lowered beneath the upper pins 24 and then raised to catch those pins. Meanwhile, the lower pins 25 or 33 are aligned with the holes 20 and are snapped into place and the implement is completely attached

I claim:

1. A device for providing quick attachment of implements to a tractor comprising a framework adapted to be attached to said tractor, said framework including hook means at its upper part and guide means at its lower part, implement attaching means including spaced apart walls on an implement adapted to embrace said hook means and guide means, upper pin means extending between said walls engageable with said hooks, lower movable pin means extendable into holes formed in said guide means, spring means engaging said movable pin means to bias said pins toward a position fully inserted into said holes in the guide means, said movable pin means including pins and means on said pins adapted to hold said pins partly withdrawn, said quide means being formed in a V-shape whereby insertion of said guide means between said walls will cause engagement of said guide means with said pin to press the pin outward against said spring means until said pins are aligned with said holes in said guide means.

2. The device of claim 1 in which said lower pins are slidably journalled in ears mounted on said implement adjacent one of said walls for each pin, said spring being engaged between one of said ears and means on said pin.

3. The device of claim 2 in which said means on said pin engaged by said spring is a fin formed on said pin, one of said ears being formed with a slot through which said fin can move, said pin being rotatable so that said fin can be moved into and out of register with said slot.

* * * * *